US011072508B2

(12) United States Patent
Miyoshi et al.

(10) Patent No.: US 11,072,508 B2
(45) Date of Patent: Jul. 27, 2021

(54) CONTROL APPARATUS

(71) Applicants: SUMITOMO HEAVY INDUSTRIES, LTD., Tokyo (JP); ASAHI KASEI KABUSHIKI KAISHA, Tokyo (JP)

(72) Inventors: Kiyoto Miyoshi, Yokosuka (JP); Takatora Ando, Yokosuka (JP); Ryuta Nakajima, Yokosuka (JP); Keita Suzuki, Tokyo (JP); Shinya Matsubara, Tokyo (JP); Taishi Hitomi, Tokyo (JP); Makoto Ikeda, Tokyo (JP)

(73) Assignees: SUMITOMO HEAVY INDUSTRIES, LTD., Tokyo (JP); ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/579,902

(22) Filed: Sep. 24, 2019

(65) Prior Publication Data

US 2020/0017328 A1 Jan. 16, 2020

Related U.S. Application Data

(63) Continuation of application No. PCT/JP2018/008136, filed on Mar. 2, 2018.

(30) Foreign Application Priority Data

Mar. 24, 2017 (JP) ..... JP2017-059639

(51) Int. Cl.

| | |
|---|---|
| ***B65H 23/192*** | (2006.01) |
| ***B41F 33/06*** | (2006.01) |
| ***B41F 33/14*** | (2006.01) |
| *B41F 9/06* | (2006.01) |
| *B41F 13/02* | (2006.01) |

(52) U.S. Cl.

CPC ..... *B65H 23/192* (2013.01); *B41F 33/06* (2013.01); *B41F 33/14* (2013.01); *B41F 9/06* (2013.01); *B41F 13/02* (2013.01)

(58) Field of Classification Search

CPC ..... B65H 23/192; B41F 33/06; B41F 33/14; B41F 9/06; B41F 13/02

See application file for complete search history.

(56) References Cited

U.S. PATENT DOCUMENTS

| | | | | |
|---|---|---|---|---|
| 3,664,261 A | | 5/1972 | Dahlgren | |
| 4,500,082 A | * | 2/1985 | Izume | B41F 7/00 101/248 |
| 4,541,335 A | | 9/1985 | Tokuno et al. | |

(Continued)

FOREIGN PATENT DOCUMENTS

| | | |
|---|---|---|
| JP | S62288038 A | 12/1987 |
| JP | H05104701 A | 4/1993 |

(Continued)

*Primary Examiner* — David H Banh

(74) *Attorney, Agent, or Firm* — HEA Law PLLC

(57) ABSTRACT

A control apparatus of a web processing system that executes predetermined processing onto a web continuously existing along a movement passage, in which the web processing system includes a rotating body that rotates while being in contact with the web, and the control apparatus controls a rotation speed of the rotating body such that a circumferential speed of the rotating body at a contact surface with the web matches a transport speed of the web.

9 Claims, 4 Drawing Sheets

(56) References Cited

U.S. PATENT DOCUMENTS

| | | | | | |
|---|---|---|---|---|---|
| 4,785,734 | A * | 11/1988 | Kawana | B41F 13/0008 | 101/181 |
| 5,511,712 | A * | 4/1996 | Holm | B65H 26/025 | 101/228 |
| 5,619,923 | A * | 4/1997 | Kotterer | B41F 33/18 | 101/226 |
| 5,890,430 | A * | 4/1999 | Wirz | B41F 13/08 | 101/216 |
| 2002/0121202 | A1 | 9/2002 | Naka | | |
| 2004/0237981 | A1* | 12/2004 | Blau | A24C 5/38 | 131/284 |
| 2005/0181118 | A1 | 8/2005 | Janssen et al. | | |
| 2005/0241505 | A1* | 11/2005 | Schwab | B41F 7/12 | 101/219 |
| 2006/0118590 | A1* | 6/2006 | Fieffer | B65H 45/12 | 226/177 |
| 2009/0153889 | A1* | 6/2009 | Boness | G03G 15/1605 | 358/1.9 |
| 2011/0011292 | A1* | 1/2011 | Rousseau | B41F 35/006 | 101/485 |
| 2011/0063357 | A1* | 3/2011 | Eun | B41J 11/008 | 347/17 |
| 2016/0273164 | A1* | 9/2016 | Omagari | D21F 7/06 | |
| 2017/0282602 | A1* | 10/2017 | Aoki | B41J 13/0009 | |
| 2018/0347115 | A1* | 12/2018 | Oguchi | B27N 3/04 | |

FOREIGN PATENT DOCUMENTS

| | | | |
|---|---|---|---|
| JP | 2006-224413 | A | 8/2006 |
| JP | 2009-234767 | A | 10/2009 |
| JP | 2013-123916 | A | 6/2013 |

* cited by examiner

2

| 182 ROTATION ANGLE [°] | 184 ROTATION SPEED [rpm] |
|---|---|
| 0 ~ 10 | N |
| 10 ~ 20 | N + 0.1 |
| 20 ~ 30 | N + 0.2 |
| ⋮ | ⋮ |
| 350 ~ 360 | N − 0.1 |

2

CONTROL APPARATUS

RELATED APPLICATIONS

The contents of Japanese Patent Application No. 2017-059639, and of International Patent Application No. PCT/JP2018/008136, on the basis of each of which priority benefits are claimed in an accompanying application data sheet, are in their entirety incorporated herein by reference.

BACKGROUND

Technical Field

A certain embodiment of the present invention relates to a control apparatus that controls a web processing system executing predetermined processing such as printing onto a web continuously existing along a movement passage.

Description of Related Art

There is a printing system as an example of a web processing system. The printing system executes printing processing onto a long object (web) which continuously exists along a movement passage, such as paper and a film. In the related art, a printing system disclosed in the related art is proposed.

The printing system is applied to, for example, Printed Electronics (PE), and higher-precision printing is required.

SUMMARY

According to an aspect of the present invention, there is provided a control apparatus of a web processing system that executes predetermined processing onto a web continuously existing along a movement passage, in which the web processing system includes a rotating body that rotates while being in contact with the web. The control apparatus controls a rotation speed of the rotating body such that a circumferential speed of the rotating body at a contact surface with the web matches a transport speed of the web.

Another aspect of the present invention also relates to a control apparatus. The apparatus is a control apparatus of a web processing system that executes predetermined processing onto a web continuously existing along a movement passage, in which the web processing system includes a rotating body that rotates while being in contact with the web. The control apparatus controls a rotation speed of the rotating body such that a circumferential speed of the rotating body at a contact surface with the web is constant.

Still another aspect of the present invention also relates to a control apparatus. The apparatus is a control apparatus of a web processing system that executes predetermined processing onto a web continuously existing along a movement passage, in which the web processing system includes a rotating body that rotates while being in contact with a non-processed surface of the web. A rotation speed of the rotating body is controlled based on a change in a distance from a rotation center of the rotating body to a processed surface of the web while the rotating body rotates one revolution.

Any combination of the configuration elements, or a configuration where the configuration elements or expressions of the present invention are mutually substituted between methods, devices, systems is also effective as an aspect of the present invention.

DETAILED DESCRIPTION

The printing system of the related art includes a rotating body that executes predetermined processing, such as printing, while rotating and being in contact with the web. The rotating body considerably includes an error in terms of processing accuracy or an attachment error. Such an error can be an obstacle to high-precision printing.

Such a problem is not limited to the printing system, and can occur even in other types of web processing systems including a rotating body that executes predetermined processing while being in contact with a web.

The present invention is devised in view of such circumstances, and it is desirable to provide a control apparatus of a web processing system for realizing higher-precision processing.

In the present invention, the control apparatus of the web processing system for realizing higher-precision processing can be provided.

Hereinafter, the same or equivalent configuration elements, members, and processes, which are shown in each drawing, will be assigned with the same reference signs, and overlapping description thereof will be omitted as appropriate. Dimensions of members in each drawing are enlarged or reduced as appropriate for easy understanding. In addition, each drawing will be shown with some of members that are not important in describing an embodiment omitted.

Figure 1:
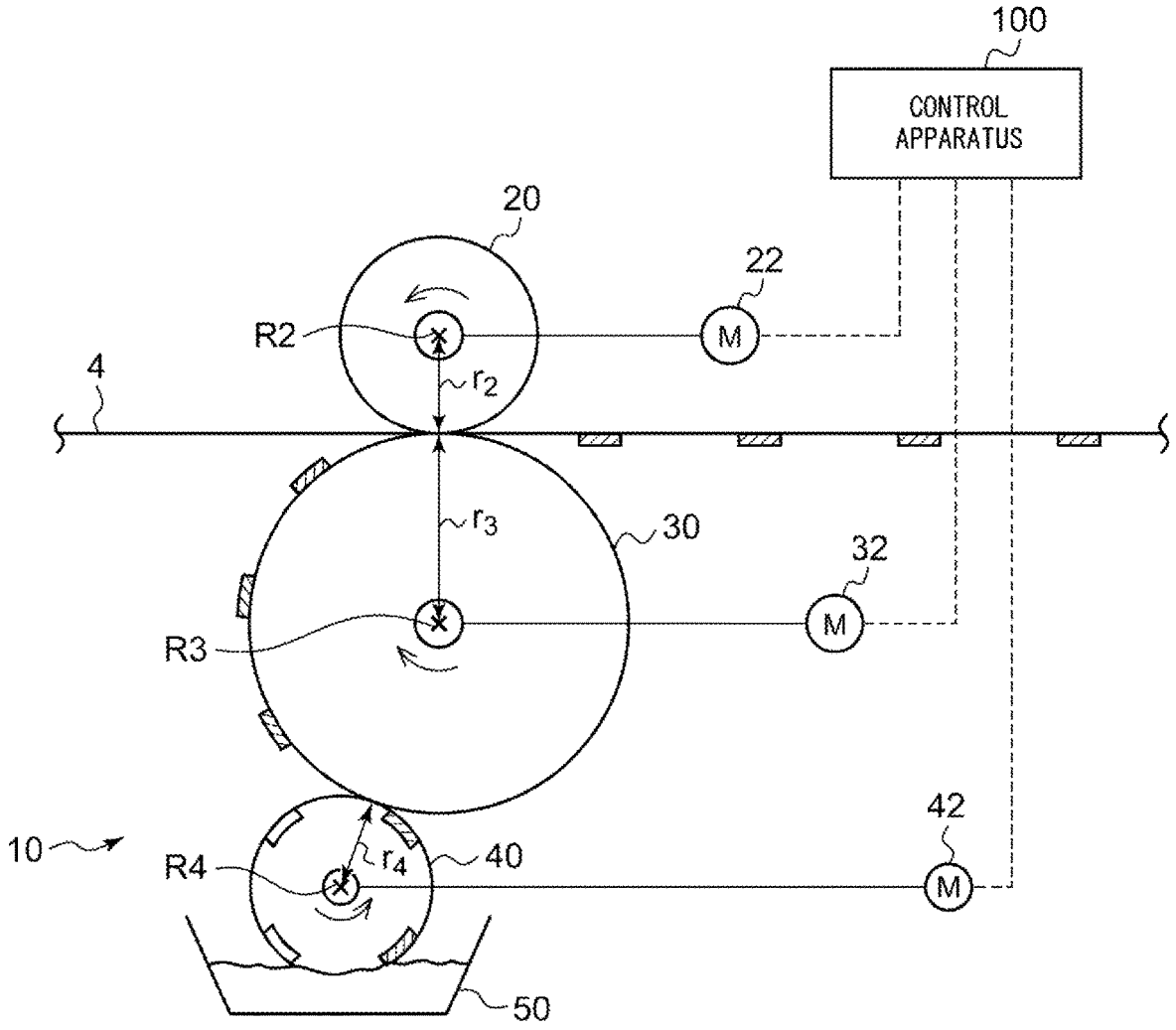
FIG. 1 is a schematic view illustrating a configuration of a web processing system including a control apparatus according to an embodiment.

FIG. 1 is a schematic view illustrating a configuration of a web processing system 2 including a control apparatus 100 according to the embodiment. The web processing system 2 of the embodiment is a printing system. The web processing system 2 moves a web 4 along a predetermined movement passage, and executes printing onto the moving web 4. The web 4 is a band-like or sheet-like substrate such as paper and a film, and continuously exists along the movement passage. Since a thickness of the web 4 is sufficiently small compared to a diameter of each cylinder to be described later, the thickness of the web 4 is not considered in the embodiment.

The web processing system 2 includes a printing device 10 that executes printing onto the web 4 and the control apparatus 100 that controls the printing device 10.

The printing device 10 is an offset printing device in the embodiment. The printing device 10 includes an impression cylinder 20, an impression cylinder drive motor 22, a blanket cylinder 30, a blanket cylinder drive motor 32, a plate cylinder 40, a plate cylinder drive motor 42, and an ink pan 50. Hereinafter, when collectively referring to the impression cylinder 20, the blanket cylinder 30, and the plate cylinder 40 or when particularly not differentiating therebetween, the impression cylinder, the blanket cylinder, and the plate cylinder will be simply called a "cylinder".

The ink pan 50 is a container accommodating an ink, and is disposed below the plate cylinder 40.

The plate cylinder 40 is a cylindrical rotating body, and a plurality of plates (recessed portions) corresponding to a print pattern to be printed onto the web 4 are formed in an outer circumferential surface thereof. The plate cylinder 40 is held to be rotatable about a rotation axis R4. The plate cylinder 40 is held in particular such that a lower portion thereof is soaked in an ink.

The plate cylinder drive motor 42 rotation-drives the plate cylinder 40 (counterclockwise in FIG. 1). The plate cylinder drive motor 42 rotation-drives the plate cylinder 40 in particular such that a circumferential speed of the plate cylinder 40 at a contact surface with the blanket cylinder 30 matches a transport speed of the web 4. The transport speed of the web 4 is substantially constant in the embodiment. In addition, even when the transport speed is a speed of a printing surface (processed surface) of the web 4, the transport speed may be a speed of a center of a thickness direction of the web 4.

The blanket cylinder 30 is a cylindrical rotating body member, and is held to be rotatable about a rotation axis R3. The blanket cylinder 30 is provided in particular such that the rotation axis R3 is parallel to the rotation axis R4 and an outer circumferential surface thereof is in contact with the outer circumferential surface of the plate cylinder 40.

The blanket cylinder drive motor 32 rotation-drives the blanket cylinder 30 (clockwise in FIG. 1). The blanket cylinder drive motor 32 rotation-drives the blanket cylinder 30 in particular such that a circumferential speed of the blanket cylinder 30 at a contact surface with the web 4 matches the transport speed of the web 4.

The impression cylinder 20 is a cylindrical rotating body, and is held to be rotatable about a rotation axis R2. The impression cylinder 20 is provided in particular such that the rotation axis R2 is parallel to the rotation axis R3 and the rotation axis R4 and an outer circumferential surface thereof presses against the outer circumferential surface of the blanket cylinder 30. The web 4 transported between the impression cylinder 20 and the blanket cylinder 30 is pressed against the blanket cylinder 30 by the impression cylinder 20.

The impression cylinder drive motor 22 rotation-drives the impression cylinder 20 (counterclockwise in FIG. 1). The impression cylinder drive motor 22 rotation-drives the impression cylinder 20 in particular such that a circumferential speed of the impression cylinder 20 at a contact surface with the web 4 matches the transport speed of the web 4.

The control apparatus 100 controls the impression cylinder drive motor 22, the blanket cylinder drive motor 32, and the plate cylinder drive motor 42.

The impression cylinder drive motor 22, the blanket cylinder drive motor 32, and the plate cylinder drive motor 42 are driven by being controlled by the control apparatus 100. The impression cylinder drive motor 22, the blanket cylinder drive motor 32, and the plate cylinder drive motor 42 rotation-drive the impression cylinder 20, the blanket cylinder 30, and the plate cylinder 40, respectively. At this time, an ink accommodated in the ink pan 50 is supplied to the plates of the plate cylinder 40 in turn, and the ink is transferred onto the outer circumferential surface of the blanket cylinder 30. The ink transferred to the blanket cylinder 30 is further transferred (printed) onto the web 4 that is being transported between the blanket cylinder 30 and the impression cylinder 20. In this manner, the printing of the web 4 is continuously performed.

The impression cylinder 20, the blanket cylinder 30, and the plate cylinder 40 each are formed in a cylindrical shape having a perfect circle cross section and are provided such that a central axis thereof matches a rotation axis. However, the cross section of each cylinder is generally not a completely perfect circle due to an error in terms of processing accuracy. In addition, to be strict, each cylinder is generally in a considerably eccentric state due to an attachment error. For this reason, a distance from a rotation axis of a cylinder to another member (hereinafter, also called a"counterpart member"), onto which the cylinder executes predetermined processing, differs according to a rotation angle of the cylinder, in other words, changes while the cylinder rotates one revolution. In the embodiment, the following distances change with the rotation of the cylinder.

(1) A distance r 2 from the rotation axis R2 of the impression cylinder 20 to the web 4 pressed by the impression cylinder 20

(2) A distance r 3 from the rotation axis R3 of the blanket cylinder 30 to the web 4 onto which the blanket cylinder 30 transfers an ink (3) A distance $r_4$ from the rotation axis R4 of the plate cylinder 40 to the blanket cylinder 30 onto which the plate cylinder 40 transfers the ink Herein, if a distance from the rotation axis of the cylinder to the counterpart member, which is a distance corresponding to a radius of the cylinder, is set as r [m], a circumferential speed v [m/s] of the cylinder at the contact surface with the counterpart member when the cylinder is rotated at a constant rotation speed N [rpm] is expressed as the following equation.

$$v=N\times 2\pi r \qquad \text{(Equation)}$$

As it is clear from the equation, in a case where the distance r changes while the cylinder rotates one revolution, the circumferential speed v is not constant and changes with the change in the distance r even when the cylinder is rotated at the constant rotation speed N. In a case where the cylinder is rotated at the constant rotation speed N, the circumferential speed v increases in particular as the distance r increases.

The change in the circumferential speed v with the change in the distance r affects an interval at which an ink is transferred onto the blanket cylinder 30 if the cylinder is the plate cylinder 40, affects the transport speed of the web 4 if the cylinder is the impression cylinder 20, and affects a position of the ink transferred onto the web 4 if the cylinder is the blanket cylinder 30.

When rotating each cylinder at a constant rotation speed without considering an error in terms of processing accuracy or an attachment error of each cylinder (hereinafter, called as a "manufacturing error" when collectively referring to the error in terms of processing accuracy and the attachment error or when particularly not differentiating therebetween), in other words, when controlling the rotation of each cylinder assuming that each cylinder is formed in an ideal shape and is attached in an ideal state, a shift in a printing position of a print pattern to be printed onto the web 4 can occur due to a manufacturing error of each cylinder that exists in reality. Thus, the control apparatus 100 according to the embodiment controls each drive motor such that an effect of such a manufacturing error on the printing position reduces. Hereinafter, details will be described.

Figures 2, 3:
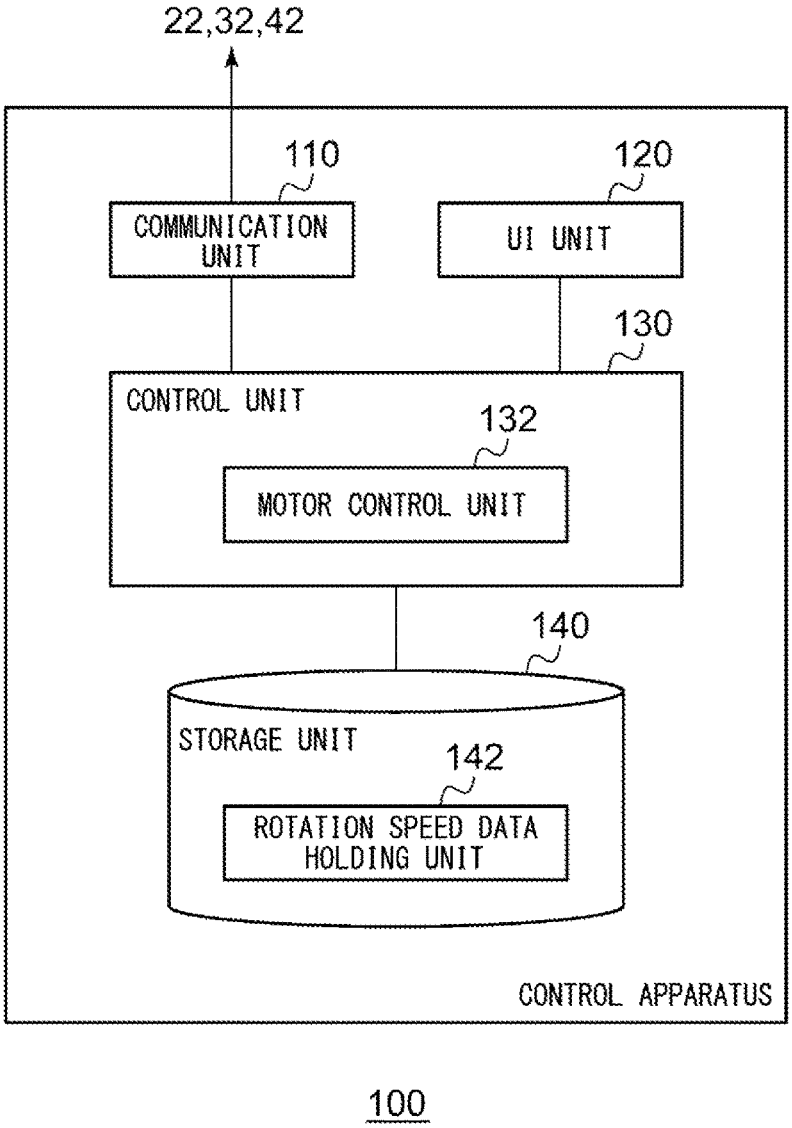
FIG. 2 is a block diagram showing a functional configuration of the control apparatus of FIG. 1.
FIG. 3 is a data structure diagram showing correction value data of a blanket cylinder, which is held by a correction value data holding unit of FIG. 2.

FIG. 2 is a block diagram showing a functional configuration of the control apparatus 100 of FIG. 1. The control apparatus 100 includes a communication unit 110, a user interface (UI) unit 120, a control unit 130, and a storage unit 140.

Each block shown herein can be realized by an element or a mechanical device, including a CPU of a computer, in terms of hardware, and is realized by a computer program in terms of software. Herein, each block is shown as a functional block realized by cooperation between hardware and software. Therefore, it is clear for those skilled in the art that the functional blocks can be realized in various forms in combination with hardware and software.

The communication unit 110 communicates with an external device in accordance with a predetermined communication protocol. For example, the control unit 130 transmits a driving instruction to each drive motor via the communication unit 110.

The UI unit 120 receives various types of inputs from a user. For example, the UI unit 120 receives an input of rotation speed data.

The storage unit 140 is a storage area that stores data to be referred to and to be updated by the control unit 130. The storage unit 140 includes a rotation speed data holding unit 142.

The rotation speed data holding unit 142 holds, for each cylinder, rotation speed data for rotating a cylinder such that a circumferential speed of the cylinder at a contact surface with a counterpart member is constant. As described above, in a case where the cylinder is rotated at the constant rotation speed N, the circumferential speed of the cylinder increases as the distance r increases. Therefore, the rotation speed data for making the circumferential speed of the cylinder constant is set such that the rotation speed of the cylinder decreases as a rotation angle brings about the longer distance r.

FIG. 3 is a data structure diagram showing an example of rotation speed data held by the rotation speed data holding unit 142. The rotation speed data of FIG. 3 is, for example, rotation speed data of the blanket cylinder 30. The rotation speed data is held by associating a rotation angle 182 with a rotation speed 184. The rotation angle 182 is a rotation angle from a reference position of a cylinder and a drive motor thereof. The rotation speed 184 indicates a rotation speed at each rotation angle. For example, the rotation speed data shows that the drive motor and the cylinder are rotated at a rotation speed of N+0.2 [rpm] in a range of the rotation angle of 20° to 30°. Although a rotation speed is set for each rotation angle of 10° in FIG. 3, the rotation speed may be set for a smaller rotation angle or may be set for a larger rotation angle.

The rotation speed data may be determined based on results of actually performing printing. A case of determining the rotation speed data of the blanket cylinder 30 will be described as an example. First, printing is performed by rotating each cylinder at each reference rotation speed. The reference rotation speed is, for example, a rotation speed calculated from a design value of each cylinder. Next, printing is performed by rotating each cylinder at each reference rotation speed in a state where only the blanket cylinder 30 is out of phase by 90°. Then, a change in a pitch of a printed print pattern is measured. A change in the distance r in a case where the blanket cylinder 30 is rotated one revolution is learned from the change in the pitch, and rotation speed data for making the circumferential speed at the contact surface with the counterpart member constant can be determined. For example, since the rotation speed of the blanket cylinder 30 decreases as the pitch increases, rotation speed data is determined such that the rotation speed increases at the rotation angle.

In addition, the rotation speed data may be determined based on results of physically measuring a change in the distance r of a cylinder. The distance r for each rotation angle of a cylinder is measured by using, for example, a laser displacement sensor and a dial gauge, and rotation angle data may be determined based on the measured distance.

Referring back to FIG. 2, the control unit 130 includes a motor control unit 132. The motor control unit 132 drives each drive motor. The motor control unit 132 rotation-drives each drive motor, in particular, based on rotation speed data held by the rotation speed data holding unit 142.

The control apparatus 100 according to the embodiment, which is described above, controls a rotation speed of each cylinder such that a circumferential speed at a contact surface with a counterpart member matches a transport speed, that is, such that the circumferential speed at the contact surface with the counterpart member is constant. Accordingly, a shift in the printing position is suppressed.

The control apparatus according to the embodiment is described hereinbefore. The embodiment is merely an example, and it is clear for those skilled in the art that various modification examples can be made to a combination of each configuration element and each processing process, and such modification examples are also in the scope of the present invention. Hereinafter, modification examples will be described.

Modification Example 1

Although a case of controlling the rotation of the impression cylinder 20, the blanket cylinder 30, and the plate cylinder 40 is described in the embodiment, a technical idea of the embodiment can also be applied to another cylinder that directly or indirectly executes the predetermined processing onto the web 4 (that is, a rotating body) without being limited thereto.

For example, even in a case of controlling the rotation of a transport cylinder that applies a speed according to the number of rotations, the technical idea of the embodiment can be applied.

In addition, for example, the printing device 10 may be other types of printing devices including a CI-type or line-type flexographic printing device and an intaglio (gravure) printing device. In this case, the technical idea of the embodiment can be applied even in a case of controlling the rotation of each cylinder that directly or indirectly executes the predetermined processing onto the web 4, the cylinder being each cylinder of other types of printing devices.

Modification Example 2

Although a case where the web processing system 2 is a printing system is described in the embodiment, the technical idea of the embodiment can also be applied to other types of web processing systems that execute the predetermined processing onto the web.

Modification Example 3

A case of controlling each drive motor such that the transport speed of the web 4 is substantially constant and the circumferential speeds of the impression cylinder 20, the blanket cylinder 30, and the plate cylinder 40 at the contact surfaces with the web 4 are such a constant speed is described in the embodiment. However, without being limited thereto, each drive motor may be controlled such that the transport speed of the web 4 changes and the circumferential speed of each cylinder at a contact surface with the web 4 matches such a changing transport speed. In this case, the web processing system 2 may further include, for example, a speed detector that measures the transport speed of the web 4. The motor control unit 132 may correct rotation speed data held by the rotation speed data holding unit 142 based on the transport speed of the web 4 calculated by the speed detector, and may rotation-drive each drive motor based on the corrected rotation speed data.

Modification Example 4

Although a case of rotating each cylinder based on rotation speed data held by the rotation speed data holding unit 142, that is, in a case of measuring a manufacturing error of each cylinder in advance and controlling the rotation of each cylinder based on the measurement result is described in the embodiment, without being limited thereto, the control apparatus 100 may measure a manufacturing error of each cylinder substantially in real time and control the rotation of each cylinder based on the measurement result.

Figure 4:
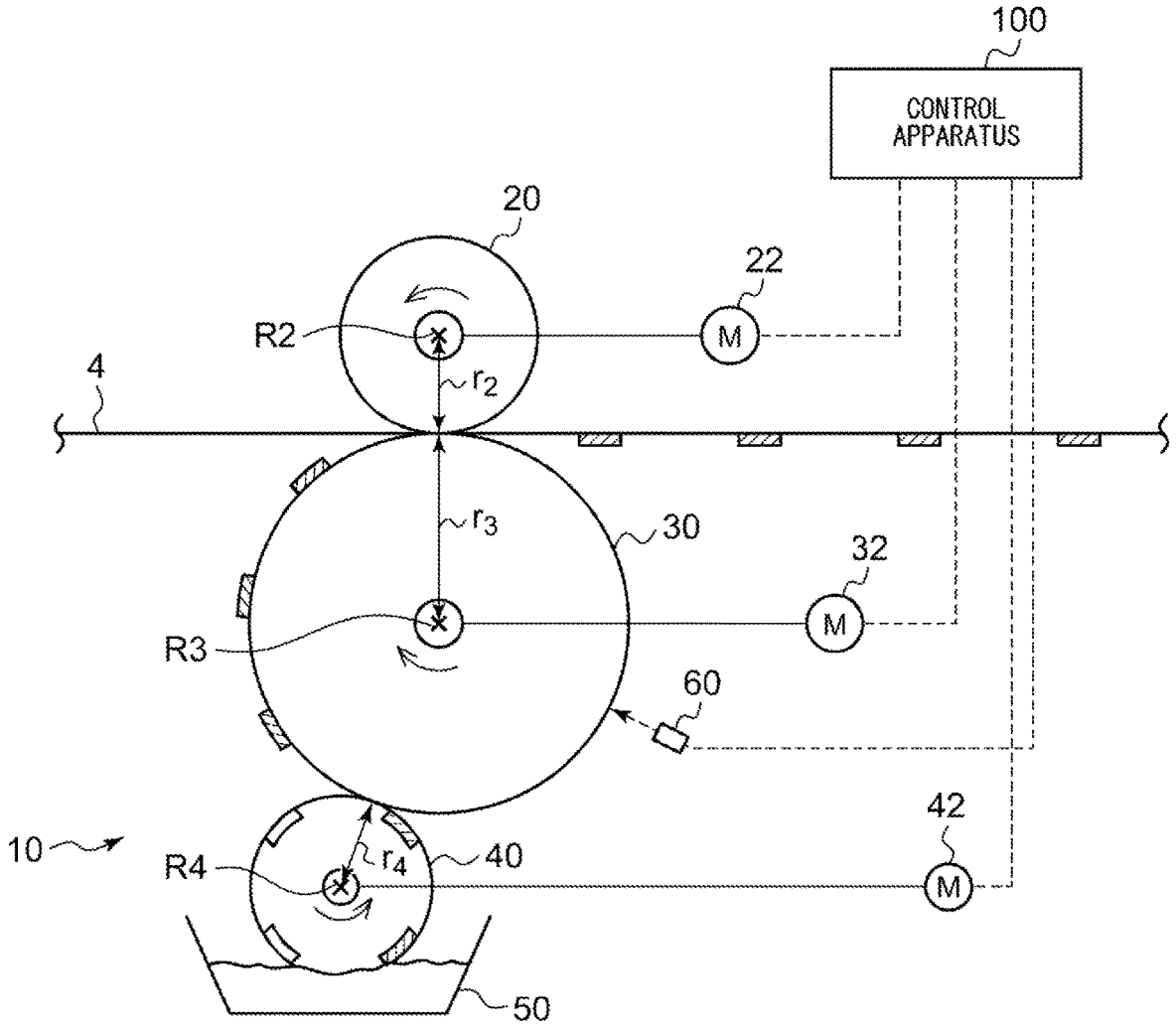
FIG. 4 is a schematic view illustrating a configuration of a web processing system according to a modification example.

FIG. 4 is a schematic view illustrating a configuration of the web processing system 2 according to the modification example. Herein, a case of measuring a manufacturing error of the blanket cylinder 30 substantially in real time and controlling the rotation of the blanket cylinder 30 based on the measurement result is described. Manufacturing errors of the impression cylinder 20 and the plate cylinder 40 may be measured substantially in real time, and the rotation of the impression cylinder 20 and the plate cylinder 40 may be controlled based on the measurement results.

The web processing system 2 further includes an error detector 60. The error detector 60 is, for example, a laser displacement sensor, and substantially detects information related to the distance r 3. Specifically, at a predetermined cycle (for example, one second cycle), the error detector 60 detects a distance from the rotation axis R3 to the outer circumferential surface of the blanket cylinder 30, that is, a distance corresponding to a radius of the blanket cylinder 30, at a position immediately before the contact surface between the blanket cylinder 30 and the web 4 in a rotation direction of the blanket cylinder 30. The motor control unit 132 controls a rotation speed of the cylinder at a timing when the detected portion comes into contact with the counterpart member based on a detected value from the error detector 60. In this case, even when a phenomenon in which a manufacturing error of the blanket cylinder 30 changes occurs, the blanket cylinder 30 can be rotated at an appropriate speed.

Modification Example 5

The thickness of the web 4 is regarded as zero in the embodiment. In the modification example, a case in which the thickness of the web is considered will be described.

Figure 5:
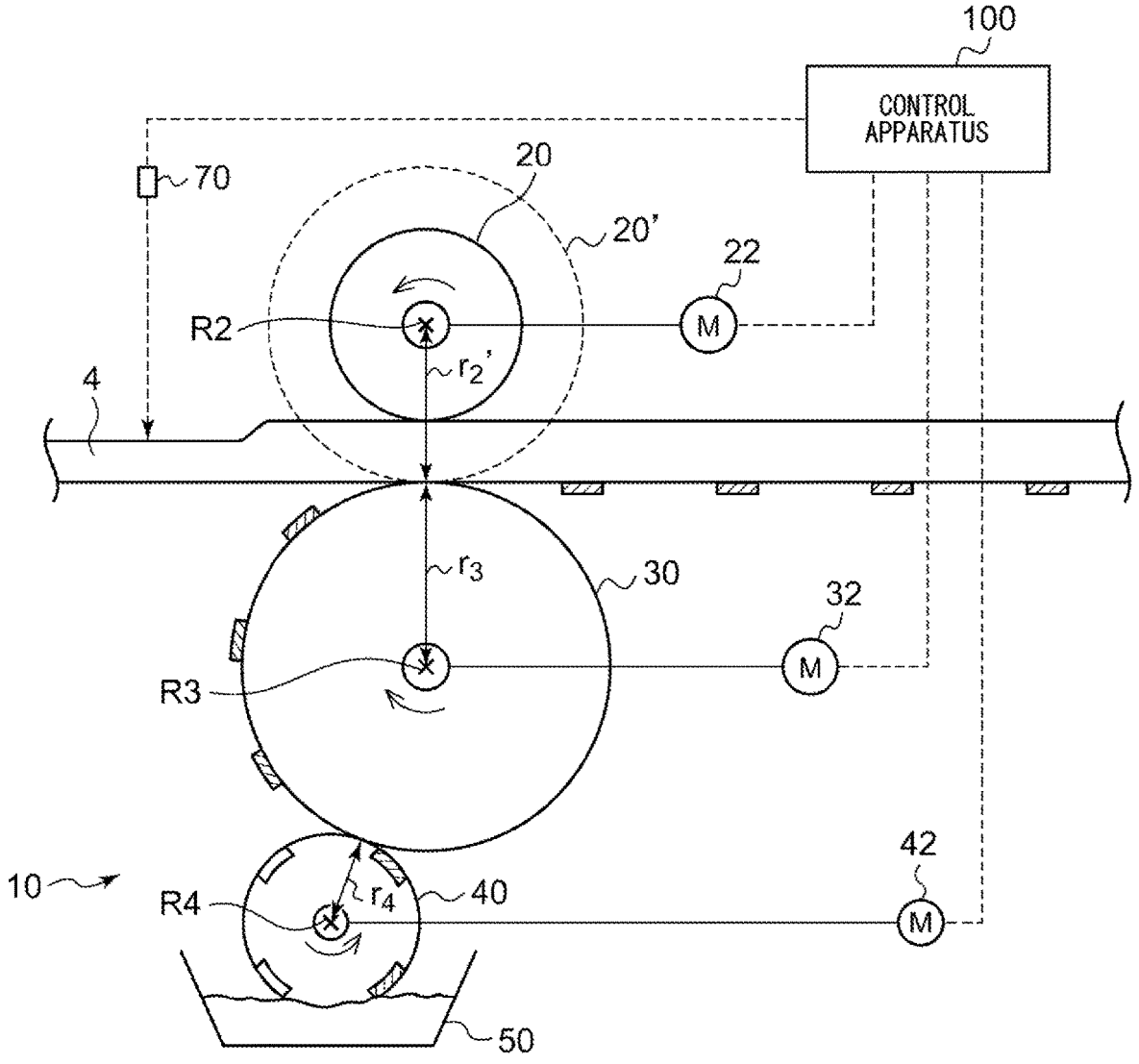
FIG. 5 is a schematic view illustrating a configuration of a web processing system according to another modification example.

FIG. 5 is a schematic view illustrating a configuration of the web processing system 2 according to another modification example. FIG. 5 is shown with the thickness of the web 4 exaggeratingly shown. The impression cylinder 20 is positioned on an opposite side to the printing surface (processed surface) of the web 4. In a case where the thickness of the web 4 is uneven in a transport direction, a distance $r_2'$ between the impression cylinder 20 and the printing surface changes due to a change in the thickness of the web 4.

The web processing system 2 further includes a thickness detector 70. The thickness detector 70 is, for example, a laser displacement sensor, and detects information related to the thickness of the web 4 substantially in real time. Specifically, on an upstream side of a pressed portion between the impression cylinder 20 and the blanket cylinder 30, the thickness detector 70 detects the thickness of the web 4 at a predetermined cycle (for example, one second cycle).

The motor control unit 132 controls the rotation speed of a cylinder in consideration of the detected thickness of the web 4. Specifically, the motor control unit 132 regards the impression cylinder 20 as a cylinder having a radius of $r_2'$ (that is, an impression cylinder 20'), and controls the rotation speed of the impression cylinder 20 such that a circumferential speed at a printing surface of the impression cylinder 20' is constant. The motor control unit 132 may correct, for example, rotation speed data of the impression cylinder 20 held by the rotation speed data holding unit 142 according to the thickness of the web 4, and may control the impression cylinder drive motor 22 with the corrected rotation speed data.

In a case where the web 4 is relatively thick and the thickness of the web 4 cannot be ignored, high-precision printing can be realized in the modification example.

Any combination of the prerequisite technology, the embodiment, and the modification examples which are described above is also useful as an embodiment of the present invention. A new embodiment generated from combination has respective combined effects of the combined embodiment and modification examples.

The present invention can be used in a control apparatus that controls a web processing system executing predetermined processing such as printing onto a web continuously existing along a movement passage.

It should be understood that the invention is not limited to the above-described embodiment, but may be modified into various forms on the basis of the spirit of the invention. Additionally, the modifications are included in the scope of the invention.

What is claimed is:

1. A control apparatus of a web processing system that executes predetermined processing onto a web continuously existing along a movement passage, wherein the web processing system includes a first rotating body that rotates while being in contact with the web, the control apparatus controls a rotation speed of the first rotating body such that a circumferential speed of the first rotating body at a contact surface with the web matches a transport speed of the web; and wherein a distance from a rotation center of the first rotating body to a contact surface of the web in contact with the first rotating body, changes as the first rotating body rotates.

2. A control apparatus of a web processing system that executes predetermined processing onto a web continuously existing along a movement passage, wherein the web processing system includes a first rotating body that rotates while being in contact with the web, and the control apparatus controls a rotation speed of the first rotating body such that a circumferential speed of the first rotating body at a contact surface with the web is constant; and wherein a distance from a rotation center of the first rotating body to the web in contact with the first rotating body, changes as the first rotating body rotates.

3. The control apparatus according to claim 1, wherein the rotation speed of the first rotating body is controlled based on a change in a distance from a rotation center of the first rotating body to the web while the first rotating body rotates one revolution.

4. The control apparatus according to claim 1, wherein the rotation speed of the first rotating body is controlled such that the rotation speed decreases as a distance from a rotation center of the first rotating body to the web increases.

5. The control apparatus according to claim 1, wherein the web processing system includes a second rotating body that stays in contact with the first rotating body, and the control apparatus controls a rotation speed of the second rotating body such that a circumferential speed of the second rotating body at a contact surface with the first rotating body matches the transport speed of the web.

6. A control apparatus of a web processing system that executes predetermined processing onto a web continuously existing along a movement passage, wherein the web processing system includes a first rotating body that rotates while being in contact with a non-processed surface of the web, and a rotation speed of the first rotating body is controlled based on a change in a distance from a rotation center of the first rotating body to a contact surface of the web in contact with the first rotating body, while the first rotating body rotates one revolution.

7. The control apparatus according to claim 6, wherein the rotation speed of the first rotating body is controlled such that the rotation speed decreases as a thickness of the web at a contact surface with the first rotating body increases.

8. The control apparatus according to claim 1, wherein the first rotating body includes a manufacturing error which causes a distance from a rotation center of the first rotating body to the web not to be constant in a circumferential direction of the rotating body; and wherein the rotation speed of the first rotating body is controlled based on the manufacturing error.

9. The control apparatus according to claim 2, wherein the first rotating body includes a manufacturing error which causes a distance from a rotation center of the first rotating body to the web not to be constant in a circumferential direction of the rotating body; and wherein the rotation speed of the first rotating body is controlled based on the manufacturing error.

* * * * *